United States Patent [19]

Carpenter, Jr. et al.

[11] Patent Number: 5,018,641

[45] **Date of Patent: * May 28, 1991**

[54] END CONSTRUCTION WITH HOLLOW BEAM CONSTRUCTION FOR A DRUM

[75] Inventors: Herbert L. Carpenter, Jr., Cullman, Ala.; James A. Hale, Red Bank, N.J.

[73] Assignee: Greif Bros. Corp., Delaware, Ohio

[ * ] Notice: The portion of the term of this patent subsequent to Aug. 28, 2006 has been disclaimed.

[21] Appl. No.: 505,984

[22] Filed: Apr. 6, 1990

Related U.S. Application Data

[63] Continuation-in-part of Ser. No. 321,965, Mar. 10, 1989.

[51] Int. Cl.[5] ..... B65D 3/30

[52] U.S. Cl. ..... 220/634; 229/5.6

[58] Field of Search ..... 229/5.6, 5.7; 220/634

[56] References Cited

U.S. PATENT DOCUMENTS

| | | | |
|---|---|---|---|
| 868,479 | 10/1907 | Railey | 220/634 |
| 1,200,263 | 10/1916 | Stollberg | 220/634 |
| 2,391,296 | 12/1945 | Coyle | 229/5.7 |
| 2,495,110 | 1/1950 | Kuhn | 220/634 |
| 3,187,974 | 6/1985 | Rodish | 229/5.7 |
| 3,288,342 | 11/1966 | Tinker | 229/5.6 |
| 3,307,766 | 3/1967 | Angstadt | 229/5.7 |
| 4,813,592 | 3/1989 | Stolzman | 229/5.7 |
| 4,890,786 | 1/1990 | Oberhofer et al. | 229/5.7 |
| 4,951,833 | 8/1990 | Carpenter et al. | 229/5.6 |

*Primary Examiner*—Gary E. Elkins
*Assistant Examiner*—S. Castellano
*Attorney, Agent, or Firm*—Kane, Dalsimer, Sullivan, Kurucz, Levy, Eisele and Richard

[57] ABSTRACT

A barrel or drum, preferably of fibre, with metal chimes responsive to longitudinal compressive forces is provided. The compressive forces urge a diagonal flange of the chimes towards the horizontal thereby expanding the outer circumference of the flange of the chime. The outer circumference of the flange of the chime has a looped or tear-drop shaped high strength hollow beam construction so as to increase the stiffness or "stretch resistance" of the flange.

11 Claims, 2 Drawing Sheets

END CONSTRUCTION WITH HOLLOW BEAM CONSTRUCTION FOR A DRUM

BACKGROUND OF THE INVENTION

This application is a continuation-in-part of application Ser. No. 321,965 filed Mar. 10, 1989.

FIELD OF THE INVENTION

This invention relates to an improved chime with high strength hollow beam construction for increasing the compressive strength which a fibre or other drum can bear.

DESCRIPTION OF THE PRIOR ART

It is well known in the prior art that the weight of a single filled drum (which is on the order of 500 pounds for a standard fifty-five gallon drum) and its contents in a static position account for only a fraction of the load which a drum must be designed to bear. Stacking of several drums one on top of another is inevitably done in transportation or storage locations in order to optimize the use of available space. This increases the static loads on the drum or barrel. However, additional strength must be built into the drum or barrel to assure that rough handling, such as might occur if a drum placed on top of other drums is lowered too quickly by a forklift truck thereby producing an impact which tends to crush the lower drums, does not compromise the integrity of the drum or barrel.

It is well known in the prior art to use a metal chime on the top and bottom of fibre or other drums or barrels to make sturdy closures which hold the bottom securely to the end of the drum shell and to provide a sturdy place to fasten the lid in order to prevent the contents from leaking or bursting from the drum. As the vertical sidewalls of the drum near the intersection of the sidewall and horizontal top or bottom of the drum are most susceptible to deformation and failure (particularly if dynamic forces are applied unevenly, such as if the drum is dropped or impacted on one of its corners), reinforcing chimes must be designed to add extra strength to the barrel or drum in anticipation of excessive external forces as shown in U. S. Pat. Nos. 4,720,038; 4,457,465; 4,483,456; 4,378,328; and 3,116,001.

Many drums are currently made from fibreboard due to its low cost and ability to bear high compressive forces. In order to take advantage of these properties in a wide range of applications, the fibre drums must be reinforced with more force resistant chimes.

However, while the use of heavier fibreboard and thicker metal chimes results in stronger barrels or drums, economic considerations require that the drums be made of conventional thickness fibre board and as thin of metal chime material as possible, in order to reduce manufacturing costs, to avoid a diversity of drum manufacturing inventory and equipment, and to avoid departing from the standard outer dimensions of a drum of a given capacity. Moreover, the shape of the chimes should be such to allow simple machining.

SUMMARY AND OBJECTS OF INVENTION

It is therefore an object of this invention to provide a drum, particularly one of fibre construction with increased strength and improved handling and stacking capabilities.

It is therefore a further object of this invention to provide a drum of increased strength which is constructed from materials of conventional thickness.

It is therefore a further object of this invention to provide a drum chime which is simple to machine.

The above and other beneficial objects and advantages are attained in accordance with the present invention by providing a drum with fibre sidewalls, top, and bottom in a conventional substantially cylindrical shape. The top and bottom portion of the sidewalls are shaped by a circular chime which clamps the top and bottom of the drum to the sidewalls around the entire periphery of both ends of the drum. The chimes are attached to the ends of the drum by a crimping procedure with a hydraulic die, as is known in the prior art, so as to attach the bottom of the drum to the sidewalls and to provide a sturdy place to attach the lid.

The chimes include a flange which extends diagonally from a crimped horizontal portion of the sidewall to the uncrimped vertical portion of the sidewall. The outermost portion, or free end, of the flange, wherein the diagonal portion of the chime terminates proximate to the undeformed portion of the drum sidewall, includes a substantially looped or "tear-drop" shaped high strength hollow beam construction of increased cross section. This looped or "tear-drop" shape is simple to machine or form and is an improvement over the rectangular shape of the parent application. This flange, in response to excessive (particularly dynamic) longitudinal forces on the undeformed sidewall, elastically deforms to a horizontal position. This elastic deformation from the diagonal to the horizontal increases the circumference of the outermost portion, or free end, of the chime (the maximum increase is approximately three percent in the preferred embodiment) thereby absorbing substantial energy. As the high strength hollow beam construction increases the second moment of area of the flange in the portion of the flange which is the most deformed under pressure, the high strength hollow beam construction increases the stiffness and load handling capacity of the flange while using a conventional thickness of chime material.

DETAILED DESCRIPTION OF THE PREFERRED EMBODIMENT

Figure 1:
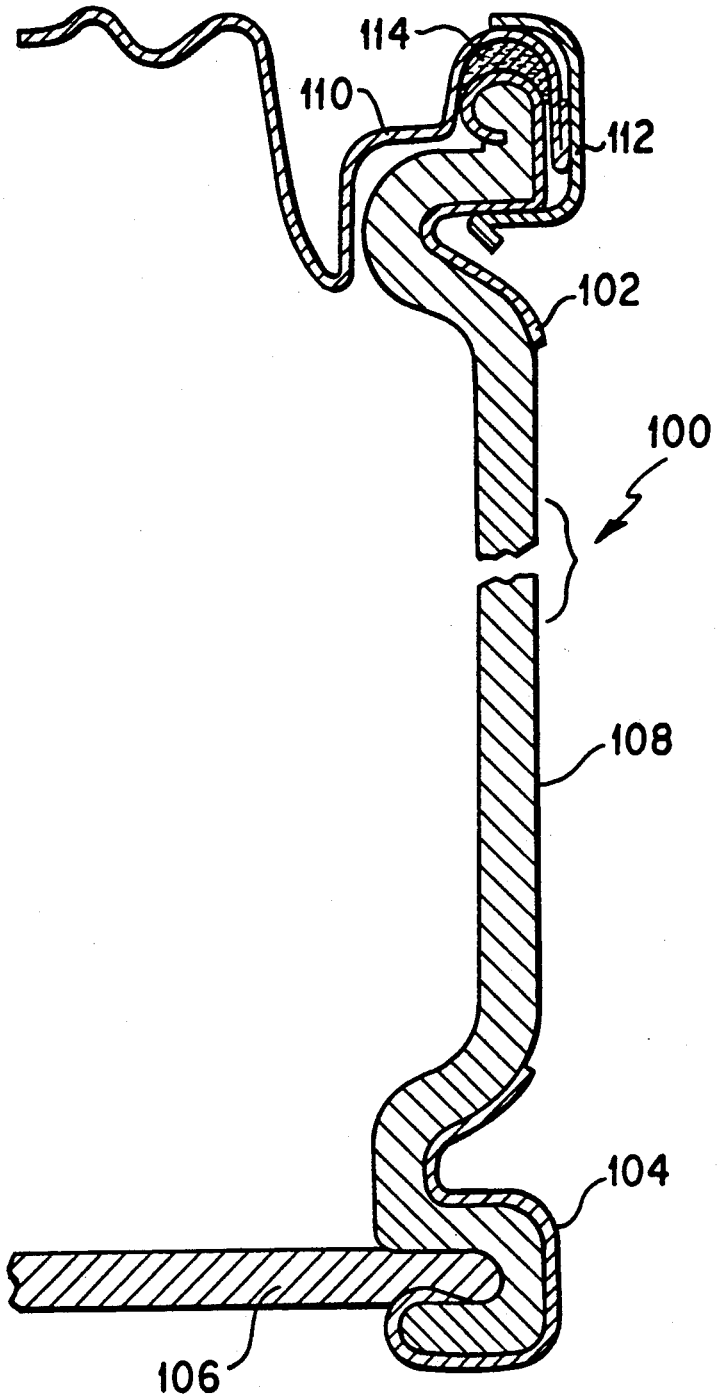
FIG. 1 PRIOR ART
FIG. 1 discloses a side cross-sectional view of a drum with prior art chimes.

Referring now to the drawings in detail wherein like numerals refer to like elements throughout the several views, FIG. 1 discloses a side cross-sectional view of a drum 100 with prior art chimes 102 and 104, bottom 106, sidewall 108, lid 110, clip 112 and gasket 114.

Figure 3:
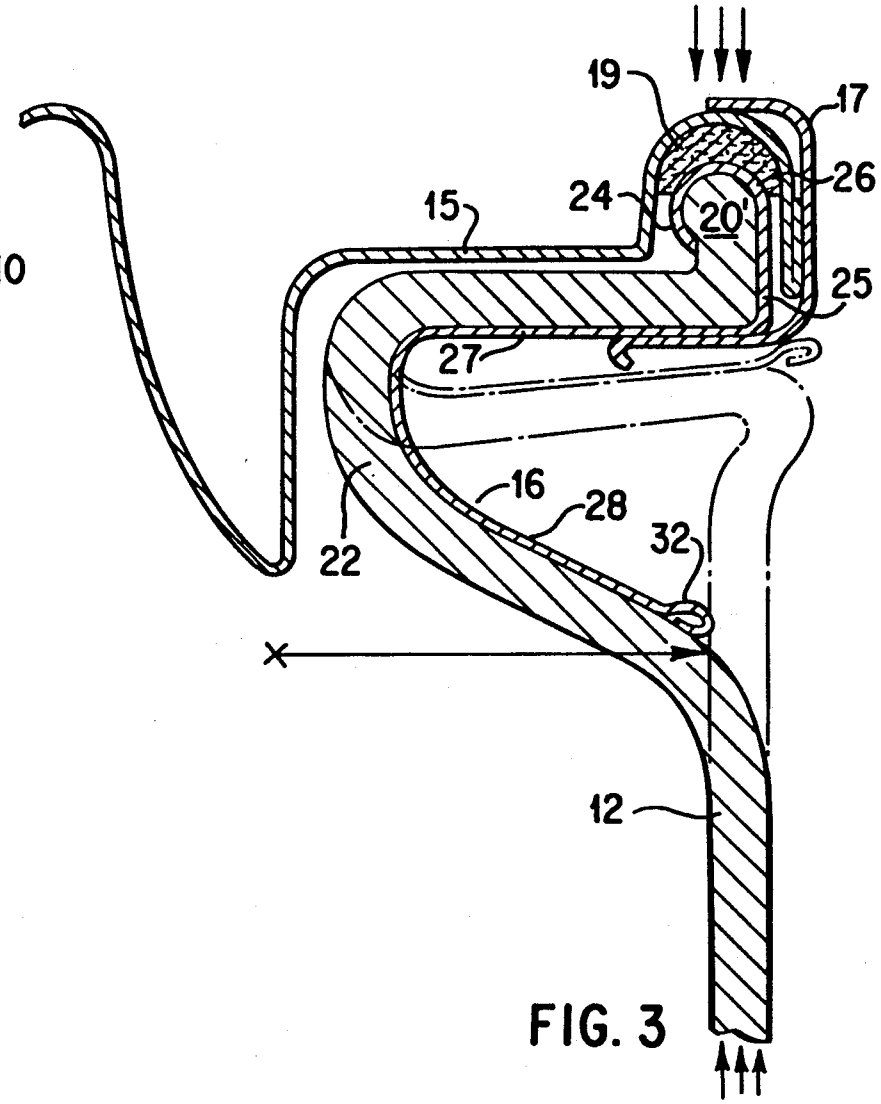
FIG. 3 discloses a side cross-sectional view of an upper drum chime of the present invention in an uncompressed configuration with the compressed configuration shown in phantom.
Figure 2:
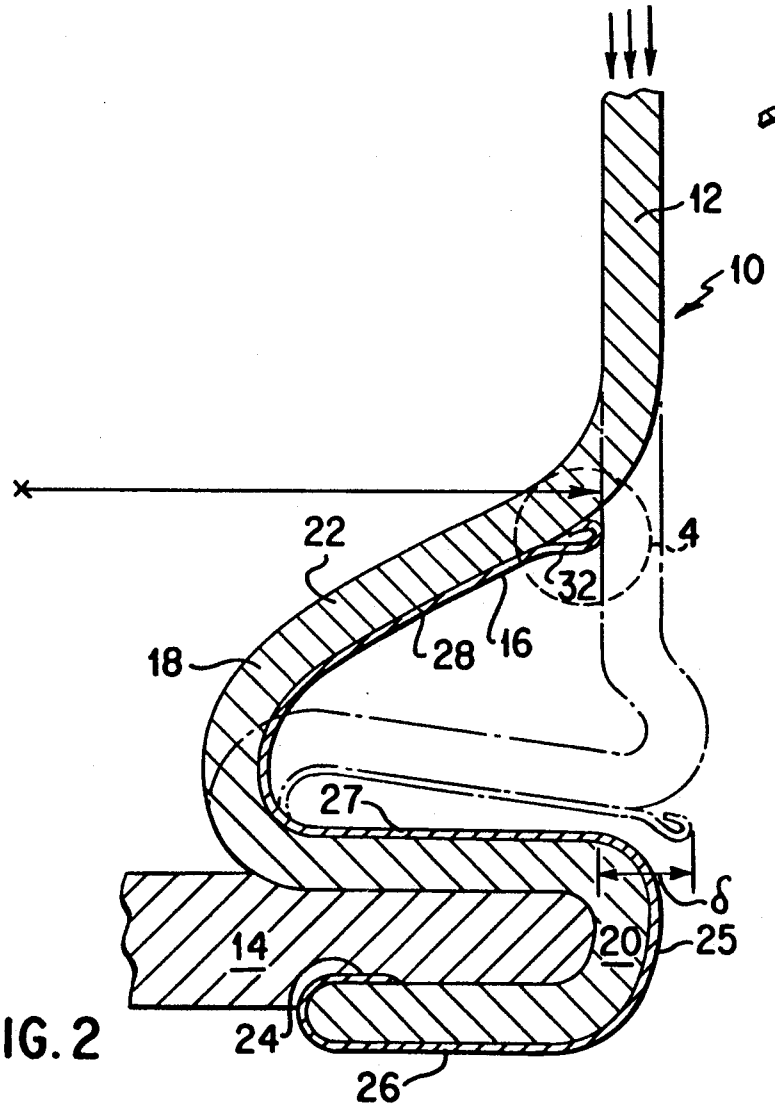
FIG. 2 discloses a side cross-sectional view of a lower drum chime of the present invention in an uncompressed configuration with the compressed configuration shown in phantom.

FIG. 2 discloses a side cross-sectional view of a lower portion of a drum with a chime of the instant invention adapted to secure a bottom to the drum, while FIG. 3 discloses a side cross-sectional view of an upper portion of a drum with a chime of the present invention adapted to provide a sturdy place of attachment for the lid.

Drum 10 includes vertical sidewall 12 and horizontal bottom 14 as shown in FIG. 2. The preferred material for sidewalls 12 and bottom 14 is fibreboard due to its high compressive strength and its low cost.

Chime 16 is made of metal, preferably electro-galvanized steel, and is crimped by a hydraulic die so as to rigidly attach sidewall 12 to bottom 14 in a liquid-proof manner as shown in FIG. 2. Sidewall 12 has a deformed S-shaped portion 18 wherein a convex portion 20 engages bottom 14 and a concave portion 22, inwardly adjacent to convex portion 20, which engages chime 16. Alternately, as shown in FIG. 3, the chime 16 attaches to sidewall 12 so as to provide a sturdy place of attachment for a lid 15. Chime 16 is adapted to receive lid 15 and clip 17 as shown in FIG. 3. Gasket 19 is made of resilient material and is compressed between the chime 16 and lid 15 thereby sealing up the contents from the intrusion of moisture, etc., from the outside of the container. Chime 16 includes an internal lip 24 which is formed between the lower surface of bottom 14 and the interior of lower convex portion 20 of S-shaped portion 18 of sidewall 12 in FIG. 2. In FIG. 3, internal lip 24 secures itself to sidewall 12. Chime 16 further includes C-shaped portion 25 wherein a first leg 26 extends from internal lip 24 and wraps around the exterior of upper leg 20' of concave portion 22 of sidewall 12. Chime 16 further includes a diagonal flange 28 which extends from a second leg 27 of C-shaped portion 25 diagonally along the exterior of concave portion 22 of S-shaped shaped portion 18 of sidewall 12.

Figure 4:
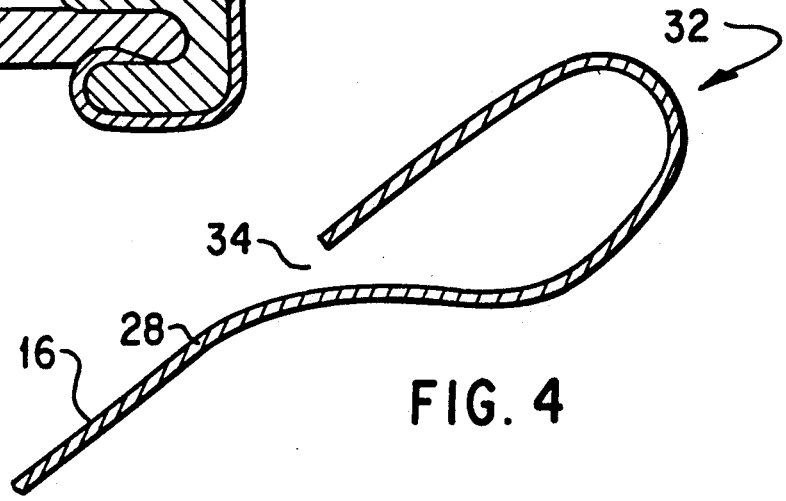
FIG. 4 discloses a close-up side cross-sectional view of the high strength hollow beam construction of the free end of the chime flange of the present invention as indicated in area 4 of FIG. 2.

The free end of flange 28 of chime 16 includes a high strength hollow beam construction 32 wherein flange 28 is formed into a looped or tear-drop shape as shown in more detail in FIG. 4. This looped or tear-drop shape is formed by turning the flange 28 inwardly toward the sidewall 12. Gap 34 may be open where the end of the sheet metal is bent back toward flange 28.

In its relaxed position, the diameter of the chime 16 as measured from the end of flange 28 (proximate to high strength hollow beam construction 32) is equal to the internal diameter of drum 10, which is in turn substantially equal to the diameter of bottom 14. This diameter is indicated as "x". In the preferred embodiment, "x" is equal to twenty inches.

When excessive downward longitudinal forces are applied to sidewalls 12, flange 28 of chime 16 flexes downwardly to a horizontal position as shown in phantom in FIG. 2 or upward as shown in phantom in FIG. 3. This increases the diameter of the chime 16 as measured from the high strength hollow beam construction 32 by an amount equal to "2δ" (the factor of two is present because δ is added to both sides of a diameter) which may be slightly greater than three percent of "x". For example, in the preferred embodiment, "x" is equal to 20 inches and "δ" is five sixteenths of an inch. Due to the high moduli of elasticity and resilience (the modulus of resilience being defined as the energy that can be elastically absorbed per unit volume) of the metal of chime 16, this stretching of the periphery of flange 28 causes substantial energy to be absorbed.

Furthermore, the presence of high strength hollow beam construction 32 increases the cross section of flange 28 thereby increasing the cross-sectional area and second moment of area of the material whose circumference is expanded, thereby resulting in a stiffer or more "stretch resistant" chime 16, able to accommodate increased static and dynamic forces on drum 10.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A drum comprising: a vertical sidewall with a circular cross section; a bottom circular end panel; and a lower circular chime including;

an inwardly directed C-shaped portion with a first and a second leg at a lower circumferential end of said sidewall and forming a lower concave portion inwardly adjacent to said C-shaped portion on said sidewall;

said first leg extending horizontally along the lower circumferential end of said sidewall and terminating with an internal lip pointing to an interior of said C-shaped portion;

said lower concave portion formed by said second leg and a first diagonal flange inwardly adjacent to said second leg; and wherein said lower circular chime engages said lower circumferential end of said sidewall so as to engage a peripheral circumference of said bottom circular end panel and wherein the internal lip of said lower circular chime is placed between said bottom circular end panel and a lower peripheral edge of said sidewall; an upper circular chime including;

an upper lip engaging an upper circumferential end of said sidewall;

an upper concave portion formed by a horizontal portion inwardly adjacent to said upper lip and a second diagonal flange inwardly adjacent to said horizontal portion;

wherein said upper circular chime engages an upper peripheral edge of said sidewall, said upper lip providing a lid seating means;

wherein said first and second flanges terminate with portions of increased cross section; and wherein longitudinal forces on said sidewall urge said first and second flanges from a diagonal toward a horizontal position thereby increasing a circumference of said portions of increased cross section as measured about a longitudinal axis of the drum;

wherein said chimes are constructed of a metal of substantially constant thickness and wherein said portion of increased cross section is formed by bending said metal;

wherein said portion of increased cross section is formed by bending said metal into a substantially tear-drop shape at ends of said first and second flanges.

2. The drum of claim 1 wherein said substantially tear drop shape includes a gap pointing inward toward the drum where an end of said metal is bend back toward said first and second flanges.

3. The drum of claim 2 wherein said circumference of said portion of increased cross section is substantially equal to an inner circumference of said sidewalls when said flange is diagonal.

4. The drum of claim 3 wherein said circumference of said portion of increased cross section when said flange is horizontal is substantially three percent greater than the circumference of said portion of increased cross section when said flange is diagonal.

5. The drum of claim 4 wherein said sidewalls and said bottom circular end panel are made of fibreboard and said chimes are made of electro-galvanized steel.

6. The drum of claim 5 further including a lid engaging said lid seating means.

7. A circular chime for drum construction including:

a portion of an inwardly opening C-shaped cross section with a first and a second leg, said first leg terminating in a lip pointing to an interior of said C-shaped cross section;

a flange extending diagonally from said second leg of said c-shaped cross-section portion terminating with a portion of increased cross-section;

wherein forces perpendicular to a diameter of said chime applied to said flange urge said flange from a diagonal toward a horizontal position and increase a circumference of said portion of increased cross section as measured about a geometric center of said circular chime;

wherein said chime is constructed of a metal of substantially constant thickness and wherein said portion of increased cross section is formed by bending said metal;

wherein said portion of increased cross section is formed by bending said metal into a substantially tear-drop shape at an end of said flange.

8. The chime of claim 7 wherein said substantially tear drop shape includes a gap pointing inward where an end of said metal is bend back toward said flange.

9. The chime of claim 8 wherein said circumference of said portion of increased cross section when said flange is diagonal is substantially equal to an internal circumference of a portion between said first and second legs of said C-shaped cross section.

10. The chime of claim 9 wherein said circumference of said portion of increased cross section when said flange is horizontal is substantially three percent greater than the circumference of said portion of increased cross section when said flange is diagonal.

11. The chime of claim 10 wherein said chime is made of electro-galvanized steel.

* * * * *